US008074573B1

(12) United States Patent
Linker

(10) Patent No.: US 8,074,573 B1
(45) Date of Patent: Dec. 13, 2011

(54) IMPACT RELEASE STUN GUN DART

(75) Inventor: Carson R. Linker, Camas, WA (US)

(73) Assignee: Global Pathogen Solutions, Inc., Camas, WA (US)

( * ) Notice: Subject to any disclaimer, the term of this patent is extended or adjusted under 35 U.S.C. 154(b) by 7 days.

(21) Appl. No.: 12/229,967

(22) Filed: Aug. 27, 2008

(51) Int. Cl.
*F42B 12/00* (2006.01)
*F42B 30/00* (2006.01)
*F41B 15/04* (2006.01)

(52) U.S. Cl. ..... 102/502

(58) Field of Classification Search ..... 102/502, 102/504, 512; 42/1.08
See application file for complete search history.

(56) References Cited

U.S. PATENT DOCUMENTS

| | | | | | |
|---|---|---|---|---|---|
| 1,381,683 | A | | 6/1921 | Weinbeer | |
| 1,807,347 | A | | 5/1931 | Schweigert | |
| 2,620,190 | A | * | 12/1952 | Bean | 473/585 |
| 3,209,696 | A | * | 10/1965 | Palmer et al. | 102/512 |
| 3,386,381 | A | * | 6/1968 | Ferb | 102/512 |
| 3,523,538 | A | * | 8/1970 | Kunio | 607/58 |
| 3,712,301 | A | * | 1/1973 | Sarnoff | 604/136 |
| 3,820,465 | A | * | 6/1974 | Delphia | 102/512 |
| 3,865,038 | A | * | 2/1975 | Barr | 102/502 |
| 4,001,963 | A | * | 1/1977 | Hamsley | 43/6 |
| 4,106,770 | A | * | 8/1978 | Gray | 473/581 |
| 4,243,036 | A | * | 1/1981 | Ott | 604/130 |
| 4,735,612 | A | | 4/1988 | Chevalier | |
| 4,822,340 | A | * | 4/1989 | Kamstra | 604/135 |
| 4,863,428 | A | * | 9/1989 | Chevalier | 604/130 |
| 5,176,643 | A | * | 1/1993 | Kramer et al. | 604/135 |
| 5,467,247 | A | | 11/1995 | de Anda | |
| 5,473,501 | A | * | 12/1995 | Claypool | 361/232 |
| 5,526,719 | A | | 6/1996 | Chen | |
| 5,695,472 | A | * | 12/1997 | Wyrick | 604/136 |
| 5,698,815 | A | * | 12/1997 | Ragner | 102/502 |
| 5,747,719 | A | | 5/1998 | Bottesch | |
| 5,833,715 | A | | 11/1998 | Vachon | |
| 5,957,897 | A | * | 9/1999 | Jeffrey | 604/223 |
| 5,962,806 | A | | 10/1999 | Coakley | |
| 6,091,597 | A | | 7/2000 | Lin | |
| 6,148,492 | A | | 11/2000 | Gaulden | |
| 6,196,979 | B1 | | 3/2001 | Virtanen | |
| 6,595,655 | B2 | | 7/2003 | Neeb | |
| 6,767,003 | B1 | | 7/2004 | Toensing | |
| 6,807,762 | B1 | | 10/2004 | Edwards | |
| 6,862,994 | B2 | * | 3/2005 | Chang | 102/502 |
| 6,877,434 | B1 | * | 4/2005 | McNulty, Jr. | 102/502 |
| 6,896,670 | B2 | | 5/2005 | Cherif Cheikh | |
| 7,065,915 | B2 | * | 6/2006 | Chang | 42/84 |

(Continued)

*Primary Examiner* — Michael Carone
*Assistant Examiner* — Reginald Tillman, Jr.
(74) *Attorney, Agent, or Firm* — Timothy E Eiegel Patent Law, PLLC; Timothy E Siegel

(57) ABSTRACT

A stun-gun dart has a bullet shaped body that defines both a cavity and a front aperture. A spear is disposed within the cavity, is aligned to the aperture and has a sharp, barbed front tip and a rear mass-piece that is wider than the aperture, to prevent the spear from entirely passing through the aperture. Also, a spring has a first end attached to the body and a second end attached to the rear mass-piece of the spear, and is properly tensioned to entirely retain the spear within cavity until the dart undergoes rapid deceleration. But when the dart, after being fired into air and hitting a target, undergoes rapid deceleration, the spring permits the tip of the spear to protrude from the aperture to engage with and barb to flesh.

8 Claims, 1 Drawing Sheet

U.S. PATENT DOCUMENTS

| | | | | |
|---|---|---|---|---|
| 7,076,903 | B2 | 7/2006 | Edwards | |
| 7,314,007 | B2 * | 1/2008 | Su | 102/502 |
| 7,327,549 | B2 * | 2/2008 | Smith et al. | 361/232 |
| 7,434,517 | B1 * | 10/2008 | Linker | 102/502 |
| 7,444,940 | B2 * | 11/2008 | Kapeles et al. | 102/502 |
| 2001/0037072 | A1 | 11/2001 | Virtanen | |
| 2003/0072148 | A1 | 4/2003 | Neeb | |
| 2004/0089186 | A1 * | 5/2004 | Brygdes-Price | 102/502 |
| 2005/0044768 | A1 | 3/2005 | Edwards | |

* cited by examiner

IMPACT RELEASE STUN GUN DART

BACKGROUND

The proliferation of stun guns among law enforcement, security forces and facilities for holding large animals throughout the world, has caused an unanticipated problem. Stun guns, such as the Taser® gun, work by shooting barbed darts into the subject. These darts are typically connected to thin wires, through which a series electric pulses is passed to pacify the subject.

After the subject has been subdued, it is necessary for a responding professional to remove the dart(s) from the subject. This is typically done by holding the subject down with one hand, while removing the dart with the other. Unfortunately, during this operation the subject may suddenly and unexpectedly move. This, in turn, may throw the responding professional off balance to the point that he inadvertently jabs the barbed end of the newly removed dart into the hand used to hold down the subject.

Far from being a minor, temporary injury, this brief event may have a life-long and tragically life-shortening effect on the responding professional, who may contract a strain of hepatitis, HIV-AIDS or any one out of a long list of blood born pathogens from blood on the dart.

This very occurrence has become all too common, with thousands of people reporting injury every year and with a percentage of those infected with a deadly virus through this type of mechanism or a related cause, such as an intravenous, arterial, subcutaneous or intramuscular needle-stick type injury. Some way must be found to make the removal of stun gun darts safer for the personnel who must remove them from the subjects as part of their profession.

Additionally, after retrieval it is desirable to take steps to preserve the dart as evidence for law enforcement.

SUMMARY

In a first, separate aspect the present invention may take the form of a stun-gun dart that has a bullet shaped body that defines both a cavity and a front aperture. A spear is disposed within the cavity, is aligned to the aperture and has a sharp, barbed front tip. The spear also has a rear mass-piece that is wider than the aperture, so as to prevent the spear from entirely passing through the aperture. In addition, a spring has a first end attached to the bullet shaped body and a second end attached to the rear mass-piece of the spear, and is properly tensioned to entirely retain the spear within cavity until the dart undergoes rapid deceleration. But when the dart, after being fired into air and hitting a target, undergoes rapid deceleration, the spring permits the tip of the spear to protrude from the aperture to engage with and barb to flesh.

In a second separate aspect, the present invention may take the form of a method of electrically connecting an animal subject to an electrical source that utilizes a stun-gun loaded with a stun-gun dart having a spear that is retained inside the dart by a spring and which is electrically connected to an electrical source. The stun-gun dart is fired from the stun-gun so that it strikes the animal subject, and the rapid deceleration of the stun gun dart caused by striking the animal subject causes the spear to protrude from the dart and barb to the flesh of the animal subject, thereby connecting the animal subject to the electrical source.

In a third separate aspect, the present invention may take the form of a method of safely removing a stun gun dart from an animal subject, that utilizes a stun-gun dart having a body defining a cavity and having a barbed spear that is barbed to the animal subject and wherein the spear is urged toward the cavity by a spring to which it is tethered. The dart is held by the body and pulled away from the animal subject so that the barb is pulled out of the animal subject, thereby permitting the spring to pull the spear into the cavity, where it can be safely stored.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENT

Figure 1:
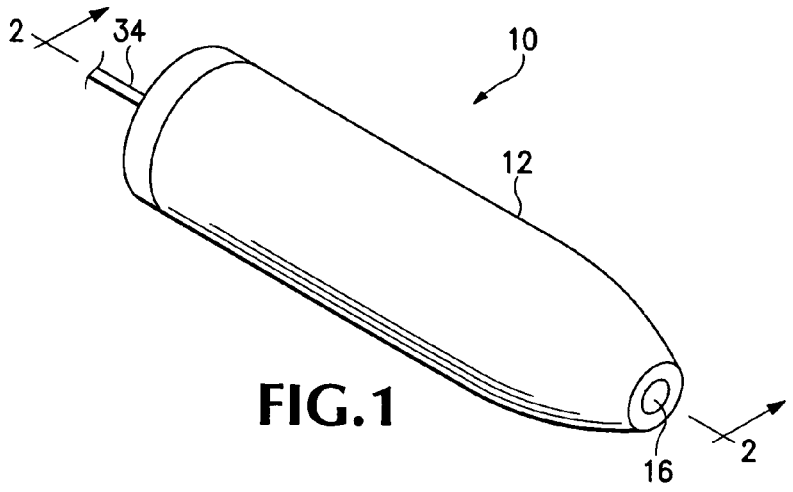
FIG. 1 is a perspective view of a stun-gun dart, in its un-deployed spear state.
Figure 2:
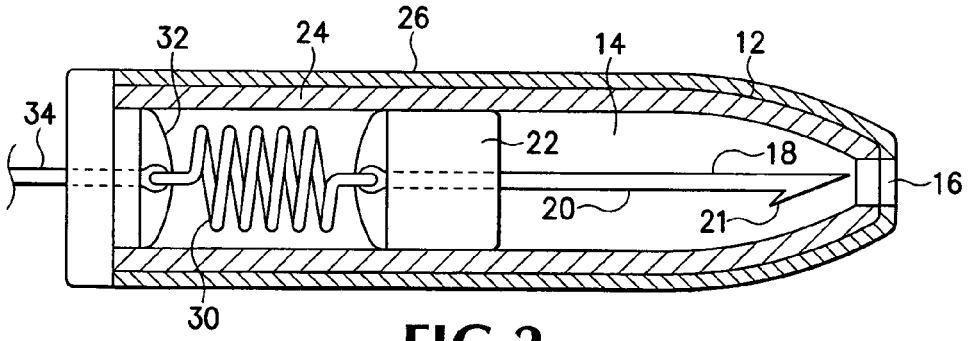
FIG. 2 is a sectional view of the stun-gun dart of FIG. 1.
Figure 3:
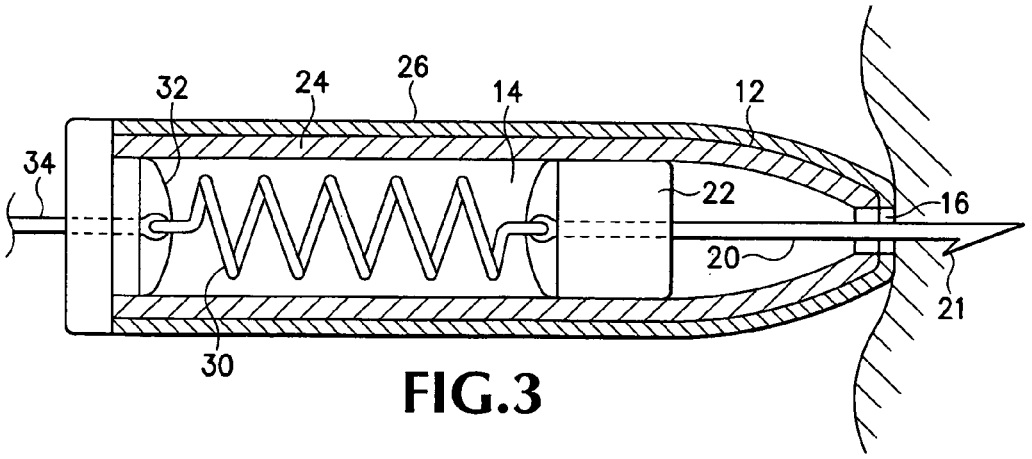
FIG. 3 is a sectional view of the stun-gun dart of FIG. 1, with its spear deployed into flesh.

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a preferred embodiment the present invention takes the form of a stun-gun dart 10, having a body 12 defining a cavity 14 and a forward aperture 16. Housed inside cavity 14 is a spear 18, which includes a shaft 20, barb 21 and a rear mass element 22. In a preferred embodiment body 12 is made of a case 24, made out of a metal such as stainless steel and bearing a coating 26 of rubber or rubber like material. A wide range of materials are available, however, to provide a case 24 having sufficient rigidity, with or without a coating that facilitates handling. For example, in an alternative preferred embodiment, case 24 is made of injection molded resin, and coating 26 is made of silicone.

Spear 18 is retained by a spring 30, held at opposite end by anchor piece 32, which also serves to electrically connect spear 18 to a wire 34. In one preferred embodiment wire 34 is connected to a current source in the associated stun gun. In an alternative preferred embodiment a current source, such as a capacitor, is stored in dart 10, and even in spear 18, obviating the need for wires. In a preferred embodiment a membrane stretches across aperture 16, to facilitate flight of the bullet.

In use dart 10 is placed in a stun-gun and fired at a subject to be stunned. The dart flies through the air with a velocity on the order of an object projected by compressed gas. When the dart body 12 hits the subject, it suddenly decelerates, but the spear 18, having its own momentum and being unrestrained moves forward so that the barb 21 protrudes through aperture 16 and engages with the flesh of the subject. Accordingly, it will typically stay in barbed engagement to the subjects flesh for long enough to deliver an electric shock, after which time it must be removed. When a responsible professional removes the barb 19 from the subject, it is free to be pulled back into cavity 14 by the tension of spring 30. In one preferred embodiment a closure is provided, so that spear 18 can be affirmatively sealed in cavity 14. In this state dart 10 is safe for handling by a responsible professional, and the spear is protected to be used as evidence. In one preferred embodiment a sealant/cover is now placed over aperture 16 so that spear 18 is safely sealed in cavity 14 and any bodily fluids on spear 18 are preserved as potential evidence.

In one preferred embodiment spring 30 is a coil spring, although any article or device that would act to urge spear 18 back into housing could serve as spring 30. In the context of this application the term "animal" includes human beings. Accordingly, an "animal subject" may be a human subject.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A stun-gun dart, comprising:

(a) a bullet shaped body, defining a cavity and a front aperture;

(b) a spear disposed within said cavity, aligned to said aperture, having a sharp, barbed front tip and a rear mass-piece that is wider than said aperture, so as to prevent said spear from entirely passing through said aperture;

(c) a spring having a first end attached to said bullet shaped body and a second end attached to said rear mass-piece of said spear, said spring having proper tension to entirely retain said spear within cavity until said dart undergoes rapid deceleration, but when said dart, after being fired into air and hitting a target, undergoes rapid deceleration, said spear has sufficient momentum, due in part to the mass of said mass piece, that said tip of said spear protrudes from said aperture to engage with and barb to flesh;

(d) wherein after said dart has hit flesh and said spear has protruded from said dart and been engaged with and barbed to said flesh and said barb has been subsequently removed from said flesh, said spring automatically retracts said spear fully back into said cavity; and (e) wherein said dart is electrically connected to a source of electricity.

2. The stun-gun dart of claim 1, wherein said aperture is covered by a membrane, to prevent said aperture from interfering with bullet travel.

3. The stun-gun dart of claim 1, wherein said body has an exterior coating of resiliently deformable material to facilitate manipulation.

4. The stun-gun dart of claim 3, wherein said resiliently deformable material is rubber.

5. The stun-gun dart of claim 3, wherein said resiliently deformable material is silicone.

6. The stun-gun dart of claim 1, wherein said spring is a coil spring.

7. The stun-gun dart of claim 1, wherein said spring is a resiliently deformable article.

8. The stun-gun dart of claim 1, further including a closure, adapted to seal said spear in said dart, once retracted.

* * * * *